US008425725B2

(12) United States Patent
Buwono et al.

(10) Patent No.: US 8,425,725 B2
(45) Date of Patent: Apr. 23, 2013

(54) PROCESS FOR IMPROVING PAPER STRENGTH

(75) Inventors: Suleman Buwono, Pekan Baru (ID); Gary Reddihough, Bradford (GB); Jozef Maria Leonardus Dogge, Bogor (ID)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/302,530

(22) Filed: Nov. 22, 2011

(65) Prior Publication Data

US 2012/0067534 A1 Mar. 22, 2012

Related U.S. Application Data

(62) Division of application No. 12/445,590, filed as application No. PCT/EP2007/060929 on Oct. 15, 2007, now Pat. No. 8,088,251.

(30) Foreign Application Priority Data

Oct. 25, 2006 (EP) ..... 06122952

(51) Int. Cl.
*D21H 11/00* (2006.01)

(52) U.S. Cl.
USPC ..... 162/164.2

(58) Field of Classification Search ..... 162/164.2, 162/164.1, 168.1, 168.3
See application file for complete search history.

(56) References Cited

U.S. PATENT DOCUMENTS

| | | | |
|---|---|---|---|
| 4,643,801 | A | 2/1987 | Johnson |
| 4,753,710 | A | 6/1988 | Langley et al. |
| 5,180,473 | A | 1/1993 | Akune et al. |
| 6,007,679 | A | 12/1999 | Nagarajan |
| 6,048,438 | A | 4/2000 | Rosencrance et al. |
| 6,113,741 | A | 9/2000 | Kettunen et al. |
| 6,454,902 | B1 | 9/2002 | Chen |
| 2002/0066540 | A1 | 6/2002 | Chen et al. |

FOREIGN PATENT DOCUMENTS

| | | | |
|---|---|---|---|
| EP | 0235893 | A1 | 9/1987 |
| EP | 0462365 | A1 | 12/1991 |
| EP | 0773319 | A | 5/1997 |
| JP | 58214597 | A | 12/1983 |
| JP | 63235596 | A | 9/1988 |
| JP | 2001279599 | A | 10/2001 |
| JP | 2003155689 | A | 5/2003 |
| JP | 2006138029 | A | 6/2006 |
| WO | WO 9824973 | A | 6/1998 |
| WO | WO 0134910 | A | 5/2001 |
| WO | WO 0233171 | A | 4/2002 |
| WO | WO 2006050848 | A1 | 5/2006 |

OTHER PUBLICATIONS

International Search Report mailed Apr. 12, 2007, issued in PCT/EP2007/060929.

Japanese Office Action issued in JP Application No. 2009-533787 dated Aug. 9, 2011 (with English-language translation).

*Primary Examiner* — Mark Halpern

(74) *Attorney, Agent, or Firm* — Drinker Biddle & Reath

(57) ABSTRACT

The present invention provides a process for preparing a paper or paper board of improved strength which comprises the steps of i) providing a cellulosic thick stock, ii) diluting the thick stock of step i) to form a thin stock, iii) draining the thin stock of step ii) on a wire to form a web, and iv) drying the web of step iii) to form paper or paper board, wherein the cellulosic thick stock of step (i) comprises organic polymeric microparticles, as well as paper obtainable by above process.

3 Claims, 1 Drawing Sheet

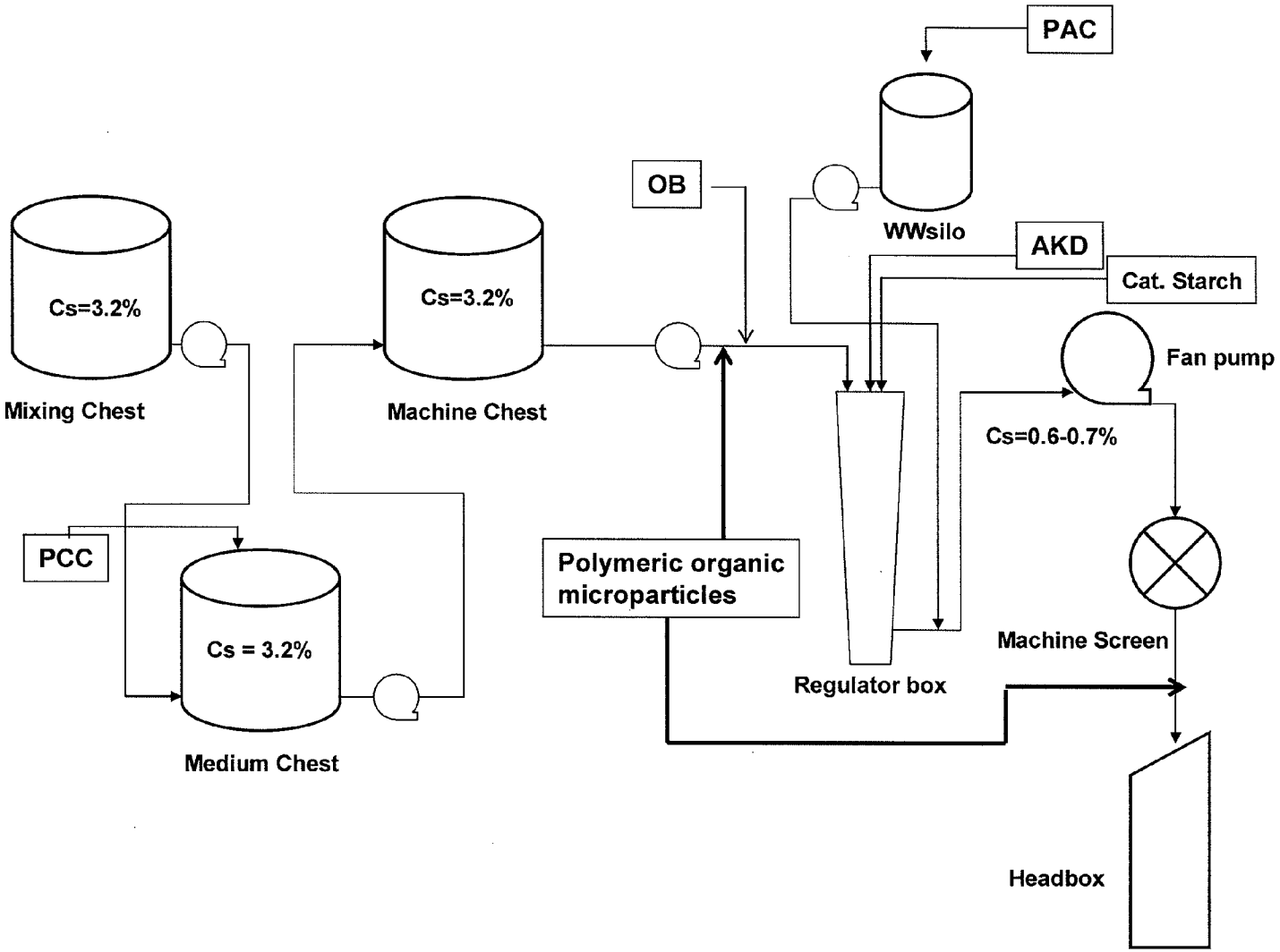
PAC
WWsilo
AKD
Cat. Starch
Fan pump
Cs=0.6-0.7%
Machine Screen
Headbox
Regulator box
OB
Polymeric organic microparticles
Cs=3.2%
Machine Chest
Cs = 3.2%
Medium Chest
Cs=3.2%
Mixing Chest
PCC

PROCESS FOR IMPROVING PAPER STRENGTH

This application is a divisional of U.S. application Ser. No. 12/445,590, filed Apr. 15, 2009, now allowed, which is a National Stage application of PCT International Application No. PCT/EP2007/060929, filed Oct. 15, 2007, which in turn claims priority under 35 U.S.C. §119 to European Patent Application No. 06122952.3, filed on Oct. 25, 2006, the disclosure of each of which is hereby incorporated by reference in its entirety herein.

The present invention refers to a process for preparing paper or paper board of improved strength and to paper or paper board obtainable by this process.

Machines used today to produce paper consist of a wet end section, a press section, a dryer section and a calendar section. In the wet end section, a thick stock of about 3% fibres in water is diluted with water or recycled water (white water), usually at the inlet of the fan pump, to form a thin stock of about 1% fibres, which is loaded via the headbox onto one or multiple wires, where a web is formed, and the drained water (white water) is collected. Various chemicals can be added to the fibres at various addition points in the wet end section to improve the properties of the final paper or the papermaking process.

For example, dry strength agents such as starch can be added in the wet end section in order to improve the strength of the final paper. Usually cationic starch is added to the thick stock and/or native starch is sprayed onto the forming web. One disadvantage of adding starch in the wet end section is that the collected white water contains starch. The presence of starch in the white water can lead to excessive bacteria growth and slime formation, and the white water has either to be disposed as expensive waste or treated with an increased amount of biocides before recycling is possible. Another disadvantage of applying starch by spraying on the forming web is that runnability problems of the machine often occur as the nozzles used to spray the starch are prone to plugging.

Wet web strength refers to the strength of the wet paper during the paper making process. The higher the strength of the wet web, the easier it is to guide the paper from the wire into the press section and consequently from the press section to the dryer section. Thus, increased wet web strength leads to a better runnability of the paper machine. Wet web strength is especially important for paper machines having no sufficient guidance between the sections, for example, machines having open draws.

It is an object of the present invention to provide a process for preparing paper or paper board of improved strength, in particular of improved internal bond strength as well as wet web strength. In addition, the process shall show good retention and formation.

This object is solved by the process described below and the paper made by the process.

This object is solved by the process of the claim 1 and the paper of claim 7.

The process of the present invention for preparing a paper or paper board comprises the steps of i) providing a cellulosic thick stock, ii) diluting the thick stock of step i) to form a thin stock, iii) draining the thin stock of step ii) on a wire to form a web, and iv) drying the web of step iii) to form paper or paper board, wherein the cellulosic thick stock of step (i) comprises organic polymeric microparticles.

The organic polymeric microparticles can be non-ionic, cationic or anionic. Preferably, the organic polymeric microparticles are cationic or anionic. More preferably, the organic polymeric microparticles are anionic. The organic polymeric microparticles are substantially water-insoluble. In the unswollen state, the organic polymeric microparticles can have a number average particle diameter of less than 1000 nm, preferably less than 750 nm, more preferably less than 300 nm.

Preferably, the organic polymeric microparticles are formed from ethylenically unsaturated monomers.

Examples of ethylenically unsaturated monomers are acrylic monomers such as (meth)acrylic acid and salts thereof, 2-acrylamido-2-methyl-1-propanesulfonic acid and salts thereof, meth)acrylamide, N—$C_{1-4}$-alkyl(meth)acrylamides, (meth)acrylamides, $C_{1-4}$-alkyl(meth)acrylates, [N,N-di($C_{1-4}$-alkyl)amino]$C_{1-6}$-alkyl (meth)acrylates and $C_{1-4}$-alkyl halide adducts thereof, [N,N-di($C_{1-4}$-alkyl)amino]$C_{1-6}$-alkyl (meth)acrylamides and $C_{1-4}$-alkyl halide adducts thereof or acrylonitril, styrene monomers such as styrene or 4-styrenesulfonic acid and salts thereof, vinyl monomers such as vinyl acetate or N-vinyl pyrrolidone, allyl monomers such as diallyldimethylammonium chloride or tetraallylammonium chloride, olefin monomers such as ethylene, propylene or butadiene, and maleic monomers such as maleic acid and salts thereof, maleic anhydride or maleimide. The salts of the respective acids can be, for example, the ammonium or alkali metal salts such as sodium salts.

Non-ionic organic polymeric microparticles can be solely formed from non-ionic ethylenically unsaturated monomers or from non-ionic, anionic and cationic ethylenically unsaturated monomers or from anionic and cationic ethylenically unsaturated monomers provided the overall cationic charge is zero. Cationic organic polymeric microparticles can be formed from cationic and optionally non-ionic and/or anionic monomers provided the overall charge is positive. Anionic organic polymeric microparticles can be formed from anionic and optionally non-ionic and/or cationic monomers provided the overall charge is negative. Preferably, anionic organic polymeric microparticles are formed from anionic and non-ionic ethylenically unsaturated monomers.

More preferably, the organic polymeric microparticles are formed from acrylic monomers, most preferably, from acrylic monomers comprising at least one acrylic anionic monomer and at least one acrylic non-ionic monomer.

Examples of acrylic anionic monomers are (meth)acrylic acid, 2-acrylamido-2-methyl-1-propanesulfonic acid and salts thereof. Preferred acrylic anionic monomers are (meth) acrylic acid and salts thereof. More preferred anionic monomers are acrylic acid and salts thereof.

Examples of acrylic non-ionic monomer are (meth)acrylamide, N—$C_{1-4}$-alkyl (meth)acrylamides such as N-methyl (meth)acrylamide), N,N-di($C_{1-4}$-alkyl) (meth)acrylamides such as N,N-dimethyl(meth)acrylamide, $C_{1-4}$-alkyl(meth) acrylates such as methyl(meth)acrylate and acrylonitril. Preferably, the acrylic non-ionic monomer is (meth)acrylamide. More preferably, it is acrylamide.

The weight ratio of acrylic anionic monomer/acrylic non-ionic monomer can be from 99/1 to 1/99. Preferably, it is 90/10 to 10/90, more preferably 80/20 to 20/80, and most preferably 70/30 to 50/50.

Preferably, the polymeric microparticle is formed in the presence of a cross-linking agent. Preferably, at least 4 molar ppm cross-linking agent is used based on the monomers. The amount of cross-linking agent is preferably between 4 to 6000 molar ppm, more preferably, between 10 and 2000 molar ppm, and more preferably, between 20 and 500 molar ppm. Examples of cross-linking agents are N,N-methylenebisacrylamide, poly(ethylene glycol)dimethacrylate, tetraallylammonium chloride and diallyl phthalate. The preferred cross-linking agent is N,N-methylenebisacrylamide.

The organic polymeric microparticles can have a solution viscosity of 1.0 to 2.0 mPas.

The organic polymeric microparticles can be prepared by microemulsion polymerization of monomers by techniques known in the art. For example, the organic polymeric microparticles can be prepared by a process comprising (i) adding an aqueous phase comprising an aqueous solution of the monomers to an oil phase comprising a hydrocarbon liquid and a surfactant or surfactant mixture to form an inverse microemulsion of small aqueous droplets in the oil phase and (ii) polymerizing the monomers in the presence of an initiator or initiator mixture to form a microemulsion comprising the polymeric microparticles.

The aqueous phase can comprise further additives such as cross-linking agents, sequesterant agents such as diethylenetriaminepentaacetic acid, penta sodium salt or pH adjusting agents such as inorganic or organic acids or bases. The aqueous phase can also comprise the (or part) of the initiator or initiator mixture.

The hydrocarbon liquid can consist of one or more liquid hydrocarbons such toluene, hexane paraffin oil or mineral oil. The weight ratio of the aqueous phase/oil phase is usually in the range of from 1/4 to 4/1, preferably in the range of from 1/2 to 2/1.

The one or more surfactants are usually selected in order to obtain HLB (Hydrophilic Lipophilic Balance) values ranging from 8 to about 11. In addition to the appropriate HLB value, the concentration of the surfactant(s) must also be carefully chosen in order to obtain an inverse microemulsion. Typical surfactants are sorbitan sesquioleate and polyoxyethylene sorbitol hexaoleate.

The initiator or initiator mixture is usually added to the aqueous phase before being mixed with the oil phase. Alternatively, part of the initiator(s) can be added to the aqueous phase and part of the initiator(s) can be added to the microemulsion obtained after mixing the aqueous and the oil phase. The initiator can be a peroxide such as hydrogen peroxide or tert-butyl hydroperoxide, a persulfate such as potassium persulfate, an azo compound such as 2,2-azobisisobutyronitrile or a redox couple consisting of an oxidizing agent and a reducing agent. Examples of oxidizing agents are peroxides and persulfates. Examples of reducing agents are sulfur dioxide and ferrous ammonium sulfate.

Optionally a chain transfer agent such as thioglycolic acid, sodium hypophosphite, 2-mercaptoethanol or N-dodecyl mercaptan can be present during polymerization.

Optionally, the organic polymeric microparticles may be isolated from the microemulsion by stripping. In addition, the organic polymeric microparticles may optionally be dried after isolation. The organic polymeric microparticles can be redispersed in water for use in papermaking.

Alternatively, the microemulsion comprising the polymeric microparticles may also be dispersed directly in water. Depending on the type and amount of surfactant(s) used in the microemulsion, dispersion in water may require using a surfactant having a high HLB value.

The cellulosic thick stock can be prepared from wood pulp which generally comes from softwood trees such as spruce, pine, fir larch and hemlock, but also from some hardwood trees such as eucalyptus and birch. The wood pulp can be chemical pulp such as kraft pulp (sulfate pulp), mechanical pulp such as groundwood, thermomechanical or chemithermomechanical pulp, or recycled pulp. The pulp can also be a mixture of chemical, mechanical and/or recycled pulp. The pulp can be bleached with oxygen, ozone or hydrogen peroxide.

The thick stock usually has a solid content ranging from 0.5 to 5%, preferably, from 1.0 to 4%, more preferably, from 1.5 to 3.5% by weight, most preferably from 2.5 to 3.5% by weight.

The thin stock is formed from the thick stock by dilution with water and usually has a solid content ranging from 0.1 to 2%, preferably, from 0.3 to 1.5%, and more preferably, from 0.5 to 1.5% by weight.

Various additives such as fillers, cationic coagulants, dry strength agents, retention aids, sizing agents, optical brighteners, and dye fixatives can be added to the stock in the wet end section. The order of addition and the specific addition points depend on the specific application, and are common papermaking practice.

Examples of fillers are mineral silicates such as talc, mica and clay such as kaolin, calcium carbonate such as ground calcium carbonate (GCC) and precipitated calcium carbonate (PCC), and titanium dioxide. The amount of filler added can be up to 60% by weight based on the dry weight of the final paper. The filler is usually added into the thick stock.

Cationic coagulants are water-soluble low molecular weight compounds of relatively high cationic charge. The cationic coagulants can be an inorganic compound such as aluminum sulfate, aluminium potassium sulfate (alum) or polyaluminium chloride (PAC) or an organic polymer such as polydiallyldimethylammoniumchloride, polyamidoamine/epichlorhydrin condensates or polyethyleneimine. The cationic coagulants are also usually added to the thick stock and serve to fix pitch and/or stickies.

Cationic coagulants, which are organic polymers, can also be added in order to neutralize the charge of the stock, which may be required, when, for example, an anionic retention aid of relatively high molecular weight is added later to the thin stock. In this case, the cationic coagulant is usually added very close to the dilution point to make thick stock into thin stock.

Examples of dry strength agents are water-soluble anionic copolymers of acrylamide of relatively low molecular weight (usually below one million g/mol) and polysaccharides of relatively high molecular weight. Examples of anionic copolymers of acrylamide are copolymers derived from acrylamide and an anionic monomer such as acrylic acid. The anionic copolymers of acrylamide are usually added to the thin stock. Examples of polysaccharides are carboxymethyl cellulose, guar gum derivatives and starch. Cationic starch, carboxymethyl cellulose and guar gum derivatives are usually added to the thick stock, whereas uncooked native starch can be sprayed on the forming web.

Preferably, retention aids are added in the wet end section in order to improve the retention of the fines, fillers and fibres on the web. Examples of retention aids are water soluble polymers, anionic inorganic microparticles, polymeric organic microparticles and combinations thereof (retention systems). The retention aids are usually added to the thin stock, after the fan pump.

The water-soluble polymers used as retention aids can be non-ionic, cationic or anionic. Examples of non-ionic polymers are polyethylene oxide and polyacrylamide. Examples of cationic polymers are copolymers derived from acrylamide and a cationic monomer such as an alkyl halide adducts of N,N-dialkylaminoalkyl (meth)acrylates, such as N,N dimethylaminoethylacrylate methyl chloride. Examples of anionic polymers are copolymers derived from acrylamide and an anionic monomer such as acrylic acid or 2-acrylamido-2 methyl-1-propane sulfonic acid. Preferably, the anionic polymers used as retention aids are of relatively high molecular weight (usually above one million g/mol).

Examples of anionic inorganic microparticles are colloidal silica and swelling clays such as bentonite. Examples of polymeric organic microparticles are described above.

Two or more retention aids can be combined to form a retention system.

Examples of retention systems are combinations of anionic water-soluble polymers and anionic inorganic microparticles and combinations of cationic water-soluble polymers, anionic water-soluble polymers and anionic inorganic microparticles. When anionic water-soluble polymers are added in combination with an anionic inorganic microparticle, the two components can be added simultaneously, or the anionic inorganic microparticle is added first, followed by the addition of the polymer. When the retention system also comprises a cationic water-soluble polymer, this cationic polymer is usually added before adding the anionic water-soluble polymer and the anionic inorganic microparticle.

Further examples of retention systems are combinations of cationic water-soluble polymers and polymeric organic microparticles and combinations of cationic water-soluble polymers, anionic water-soluble polymers and polymeric organic microparticles.

Preferably, the retention aid is a cationic water-soluble polymer or a retention system comprising a cationic water-soluble polymer.

Examples of sizing agents are natural sizing agents such as rosin and synthetic sizing agents such as alkenyl succinic anhydride (ASA) and alkyl ketene dimer (AKD).

Examples of optical brighteners are stilbene derivatives such as sold, for example, under the tradename Ciba® Tinopal® CBS-X.

The organic polymeric microparticles can be added to the thick stock, before or after or in between addition of the other thick stock additives.

The organic polymeric microparticles can be added in solid form or as an aqueous dispersion. Typically, the organic polymeric microparticles are added as an aqueous dispersion having a solid content of below 1% by weight.

Usually, the amount of organic polymeric microparticles added to the thick stock is from 50 to 5000 ppm, preferably, from 100 to 3000 ppm, more preferably, from 300 to 2000 ppm, and most preferably from 400 to 1000 ppm by weight based on the dry weight of the stock.

When, organic polymeric microparticles are additionally added to the thin stock as retention aid, the amount of organic polymeric microparticles added to the thin stock ranges from 50 to 5000 ppm, preferably, from 100 to 3000 ppm, more preferably, from 300 to 2000 ppm, and most preferably from 300 to 1000 ppm by weight based on the dry weight of the stock.

Also part of the invention is paper or paper board obtainable by the process the present invention.

Also part of the invention is a method for improving the strength, in particular the internal bond strength as well as the wet web strength, of paper or paper board which comprises adding organic polymeric microparticles into the thick stock.

The advantage of the process for preparing paper or paper board of the present invention is that the addition of the organic polymeric microparticles to the thick stock considerably improves wet-web strength and consequently the runnability of the machine in the press and dryer sections.

A further advantage of the process of the present invention is that no addition of starch or only the addition of a reduced amount of starch in the wet end section is necessary in order to achieve paper of high dry strength, in particular high internal bond strength. Thus, the entire process is easier as it requires less addition steps. In particular the spraying of starch onto the web, that usually causes runnability problems, can now be avoided. In addition, the white water collected in the wet end section does not contain starch or does only contain a reduced amount of starch. As the presence of starch in the white water usually leads to excessive bacteria growth and slime formation, which requires the addition of increased amounts of biocides, the absence of starch or the presence of a reduced amount of starch means that reduced slime formation occurs and that only a reduced amount of biocides is necessary.

FIG. 1 outlines the process of the present invention for the preparation of paper or paperboard in a paper mill.

EXAMPLES

Example 1

Preparation of Organic Polymeric Microparticles

Organic polymeric microparticles are prepared from acrylamide/acrylic acid (48% by weight as ammonium acrylate) in a weight ratio of 40/60 in the presence of 53 molar ppm methylenebisacrylamide based on all monomers in analogy to the "Procedure for the Preparation of Anionic Microemulsion" on page 9, lines 14 to 38 of EP 0 462 365 A1, except that sodium hydroxide is replaced by ammonium hydroxide.

Example 2

Packaging Board of 100 g/m$^2$ is Prepared Using a Fourdrinier Machine that Produces 10 to 11 t/h Paper at a Speed Close to 320 m/min.

The wet end section is outlined in FIG. 1 and further explained as follows: A thick stock is prepared containing 3.2% by weight fibres (12% Needle Bleached Kraft Pulp and 88% Leaf Bleached Kraft Pulp) and beaten to 390 to 420 ml Canadian Standard. 20% by weight precipitated calcium carbonate (PCC) based on the dry weight of the fibres. To the thick stock containing fibre and filler and having a solid content of 3.2% by weight, 711 ppm by weight organic polymeric microparticles of example 1, 0.45% by weight optical brightnener (OB), 0.9% by weight alkenyl ketene dimer (AKD) and 0.015% by weight polyaluminium chloride (PAC), all based on the dry weight of the fibres, are added. Before the fan pump, the thick stock is diluted to 0.6 to 0.7% by weight solid content using white water to form a thin stock. After passing the machine screen, the step of last high shear, additional 633 ppm by weight of organic polymeric microparticles of example 1 are added. The thin stock is then loaded via the headbox onto the wire.

The first pass retention is 82.3, and the ash first pass retention is 66.0.

Comparative Example 1

The process of example 1 is repeated but no organic polymeric microparticles are added to the thick stock, and 1200, instead of 633, ppm by weight polymeric microparticles are added to thin stock shortly before the headbox. In addition, 0.8% by weight Ciba® Raisamyl® 40041, a cationic starch, is added to the thick stock, and 0.6% by weight native starch is sprayed onto the wet-web, shortly after the forming board, the first drainage element, in a fine upward parabolic shower. The starches are given in % by weight based on the dry weight of all papermaking materials.

Test Results:

Internal bond strength of paper or paperboard is the ability of the product to resist splitting when a tensile load is applied through the paper's thickness i.e. in the Z direction of the sheet, and is a measure of the internal strength of the paper or paperboard. The internal bond strengths of the packaging board obtained in example 1 and of the packaging board obtained in comparative example 1 are measured with a Scott Bond Tester.

TABLE 1

| | Starch added to thick stock [%] | Starch sprayed onto Web [%] | OPM[1] added to thick stock [ppm] | OPM[1] added before headbox [ppm] | Internal Bond Strength [J/m$^2$] | Formation |
|---|---|---|---|---|---|---|
| Example 2 | 0 | 0 | 711 | 633 | 194.8 | 86.2 |
| Comp. ex. 1 | 0.5 | 0.6 | 0 | 1200 | 175.0 | 89. |

[1]organic polymeric microparticles.

It can be seen from table 1 that the internal bond strength and thus the internal bond strength of the paper increases when the organic polymeric microparticles are not exclusively added after the last shear step and before the headbox, but part of organic polymeric microparticles is also fed into the thick stock. It is even more surprising that the split addition of organic polymeric microparticles allows the complete omission of starch. The formation is similar in both processes.

In addition, the wet-web strength is increased considerably in the process of example 2 compared to the process of comparative example 1.

The invention claimed is:

1. A method for improving the strength of paper or paper board comprising:

adding anionic organic polymeric microparticles into a thick stock, wherein the anionic organic polymeric microparticles are formed from a composition comprising at least one acrylic anionic monomer and at least one acrylic non-ionic monomer, wherein the acrylic anionic monomer is at least one of (meth)acrylic acid, 2-acrylamido-2-methyl-1-propanesulfonic acid, or salts thereof.

2. The method of claim 1, wherein the acrylic non-ionic monomer is at least one of (meth)acrylamide, an N—$C_{1-4}$-alkyl (meth)acrylamide, an N,N-di($C_{1-4}$-alkyl)(meth)acrylamides, or a $C_{1-4}$-alkyl(meth)acrylamides.

3. A method of improving the strength of paper or paper board comprising:

i) providing a cellulosic thick stock, ii) diluting the cellulosic thick stock of step i) to form a thin stock, iii) draining the thin stock of step ii) on a wire to form a web, and iv) drying the web of step iii) to form paper or paper board, wherein the cellulosic thick stock of step i) comprises anionic organic polymeric microparticles, wherein the anionic organic polymeric microparticles are formed from a composition comprising at least one acrylic anionic monomer and at least one acrylic non-ionic monomer, and wherein the acrylic non-ionic monomer is at least one of an N—$C_{1-4}$-alkyl (meth)acrylamide, an N,N-di($C_{1-4}$-alkyl)(meth)aerylamides, or an $C_{1-4}$-alkyl(meth)acrylamides; and the acrylic anionic monomer is at least one of (meth)acrylic acid; 2-acrylamido-2-methyl-1-propanesulfonic acid; or salts thereof.

* * * * *